US006897873B2

(12) United States Patent
Sasaki

(10) Patent No.: US 6,897,873 B2
(45) Date of Patent: May 24, 2005

(54) DISPLAY CONTROL APPARATUS HAVING REPLACEABLE COLOR PALETTE

(75) Inventor: Toru Sasaki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 285 days.

(21) Appl. No.: 09/821,327

(22) Filed: Mar. 29, 2001

(65) Prior Publication Data

US 2002/0011995 A1 Jan. 31, 2002

(30) Foreign Application Priority Data

Mar. 30, 2000 (JP) ..... 2000-095640

(51) Int. Cl.[7] ..... G09G 1/02

(52) U.S. Cl. ..... 345/549; 345/72; 345/88; 345/530; 345/531; 345/532; 345/533; 345/536; 345/538; 345/543; 345/547; 345/589; 345/593; 345/600

(58) Field of Search ..... 345/72, 88, 530–532, 345/533, 536, 538, 543, 547, 549, 589, 593, 600, 87, 204, 418, 537, 591, 619, 656, 690

(56) References Cited

U.S. PATENT DOCUMENTS

| | | | | | |
|---|---|---|---|---|---|
| 5,400,334 | A | * | 3/1995 | Hayssen | 370/245 |
| 5,473,348 | A | * | 12/1995 | Fujimoto | 345/569 |
| 5,500,654 | A | * | 3/1996 | Fujimoto | 345/634 |
| 5,559,952 | A | * | 9/1996 | Fujimoto | 345/557 |
| 5,929,839 | A | * | 7/1999 | Matsumoto | 345/589 |
| 6,320,778 | B1 | * | 11/2001 | Tanaka et al. | 365/49 |
| 6,388,675 | B1 | * | 5/2002 | Kamada et al. | 345/600 |
| 2002/0050999 | A1 | * | 5/2002 | San et al. | 345/530 |

FOREIGN PATENT DOCUMENTS

| | | |
|---|---|---|
| JP | 08-167038 | 6/1996 |
| JP | 08-305332 | 11/1996 |
| JP | 2000-066651 | 3/2000 |
| JP | 2000-235382 | 8/2000 |

OTHER PUBLICATIONS

Japanese Office Action dated Jan. 4, 2005.

* cited by examiner

*Primary Examiner*—Bipin Shalwala
*Assistant Examiner*—Vincent E. Kovalick
(74) *Attorney, Agent, or Firm*—Pillsbury Winthrop LLP

(57) ABSTRACT

A display control apparatus contains a video memory, a video memory controller, a color palette memory and a color palette replacer signal generator. The video memory stores display data that are read from a CD-ROM and contain header data (HA-HD), palette data (P0–P2) and bitmap data (BA–BD) in connection with four planes which are combined together to form one frame of picture. The header data contain a color palette pointer (CPP) and a color palette replacer instruction (CPP31) with respect to each of the planes. The video memory controller reads the palette data and bitmap data from the video memory in accordance with addresses designated by the header data. The color palette replacer signal generator generates a color palette replacer signal (COL) based on the header data so as to make determination whether to replace contents of color palettes with respect to the planes respectively. If the color palette replacer instruction designates color palette replacement, the video memory controller unconditionally replaces previous palette data with present palette data on the color palette memory. If the color palette replacer instruction does not designate color palette replacement, the video memory controller replaces the previous palette data with the present palette data on the color palette memory only when a present color palette pointer designating the present palette data differs from a previous color palette pointer designating the previous palette data. Thus, it is possible to considerably reduce time for replacement of contents of the color palettes.

11 Claims, 8 Drawing Sheets

DISPLAY SCREEN

DISPLAY CONTROL APPARATUS HAVING REPLACEABLE COLOR PALETTE

BACKGROUND OF THE INVENTION

1. Field of the Invention

This invention relates to display control apparatuses having replaceable color palettes providing colors for displaying color images on screens of displays.

2. Description of the Related Art

As compared with the existing displays that can display images using fixed sets of colors on screens, a large number of displays are developed in these days to incorporate display control apparatuses having replaceable color palettes, which allow desired multi-color images to be displayed on screens. The aforementioned displays are advantageous because desired colors can be easily displayed on the screens by merely replacing the color palettes.

In general, the color palettes have relatively large amounts of data to actualize large number of colors being displayed on the screens of the displays. Hence, the display control apparatuses need much time to replace the color palettes. During replacement of the color palettes, it is difficult to take sufficient time for draw controls and data transfers.

SUMMARY OF THE INVENTION

It is an object of the invention to provide a display control apparatus that is improved by reducing time for replacement of color palettes.

A display control apparatus contains a video memory, a video memory controller, a color palette memory and a color palette replacer signal generator. The video memory stores display data that are read from a CD-ROM and contain header data (HA–HD), palette data (P0–P2) and bitmap data (BA–BD) in connection with four planes which are combined together to form one frame of picture. The header data contain a color palette pointer (CPP) and a color palette replacer instruction (CPP31) with respect to each of the planes. The video memory controller reads the palette data and bitmap data from the video memory in accordance with addresses designated by the header data. The color palette replacer signal generator generates a color palette replacer signal (COL) based on the header data so as to make determination whether to replace contents of color palettes with respect to the planes respectively. If the color palette replacer instruction designates color palette replacement, the video memory controller unconditionally replaces previous palette data with present palette data on the color palette memory. If the color palette replacer instruction does not designate color palette replacement, the video memory controller replaces the previous palette data with the present palette data on the color palette memory only when a present color palette pointer designating the present palette data differs from a previous color palette pointer designating the previous palette data. Thus, it is possible to considerably reduce time for replacement of contents of the color palettes.

In addition, the header data also contain a bitmap data format (BDF) representing a format of the bitmap data with respect to each of the planes, so that the bitmap data are converted to RGB color data on the color palette memory in response to the bitmap data format. Thus, a display shows color images based on the RGB color data on a screen.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

Figure 1:
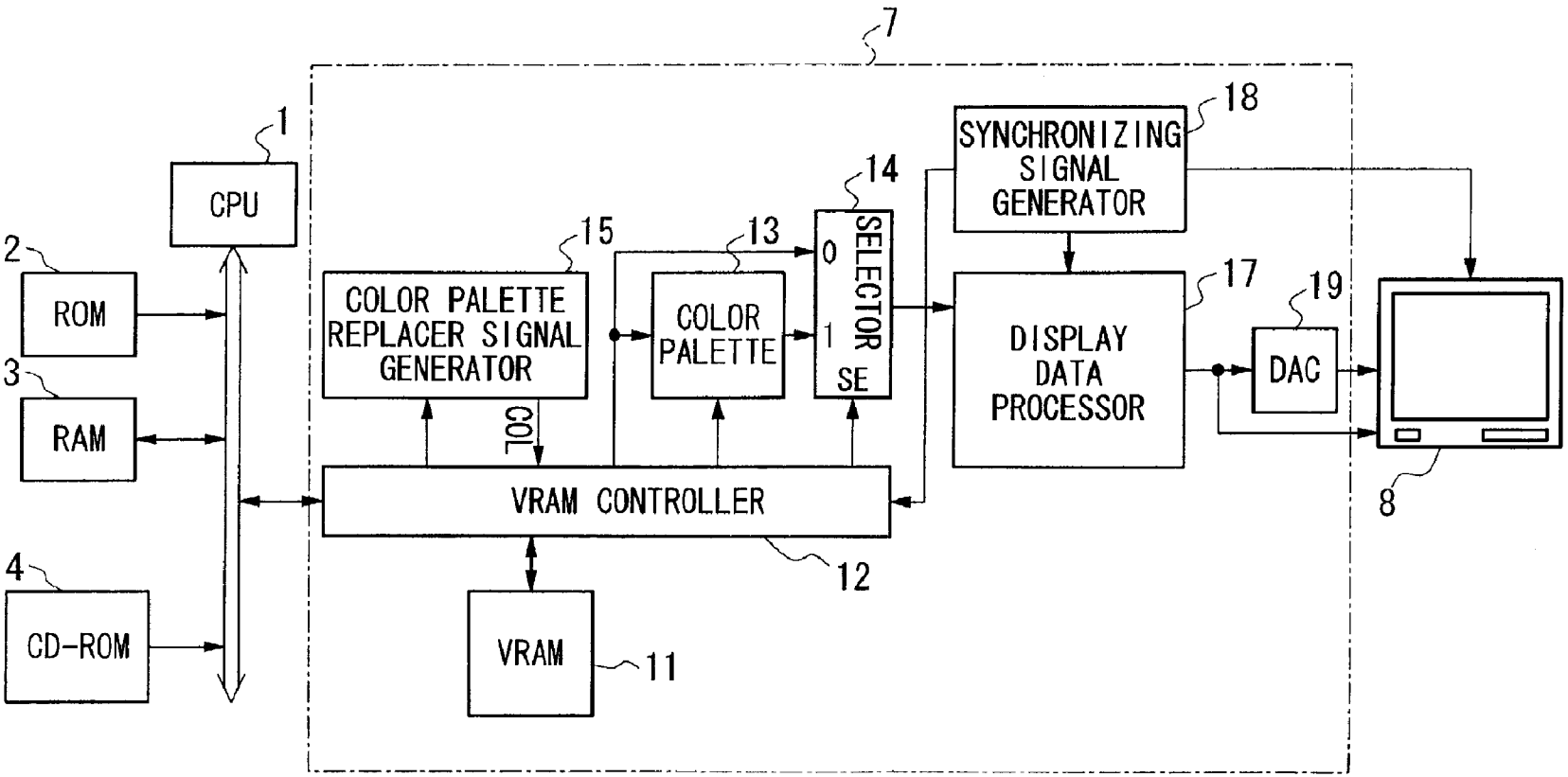
FIG. 1 is a block diagram showing an electric configuration of a display system incorporating a display control apparatus in accordance with an embodiment of the invention.

FIG. 1 shows an electric configuration of a display system incorporating a display control apparatus in accordance with an embodiment of the invention. In FIG. 1, a reference numeral 1 designates a central processing unit (CPU), 2 designates a read-only memory (ROM) for storing programs to be executed by the CPU 1, 3 designates a random-access memory (RAM) for storing a variety of data, 4 designates a CD-ROM drive, 7 designates a display control apparatus according to the present embodiment, and 8 designates a display for displaying characters and images on a screen on the basis of display signals output from the display control apparatus 7. Namely, the display 8 displays on the screen contents of display data that are read from a CD-ROM inserted into the CD-ROM drive 4 and are transferred to the display control apparatus 7 under the control of the CPU 1.

Next, a description will be given with respect to details of the display control apparatus 7. A reference numeral 11 designates a video RAM (or VRAM) to which the display data given from the CD-ROM are written. Contents of the display data will be described below.

Figure 2:
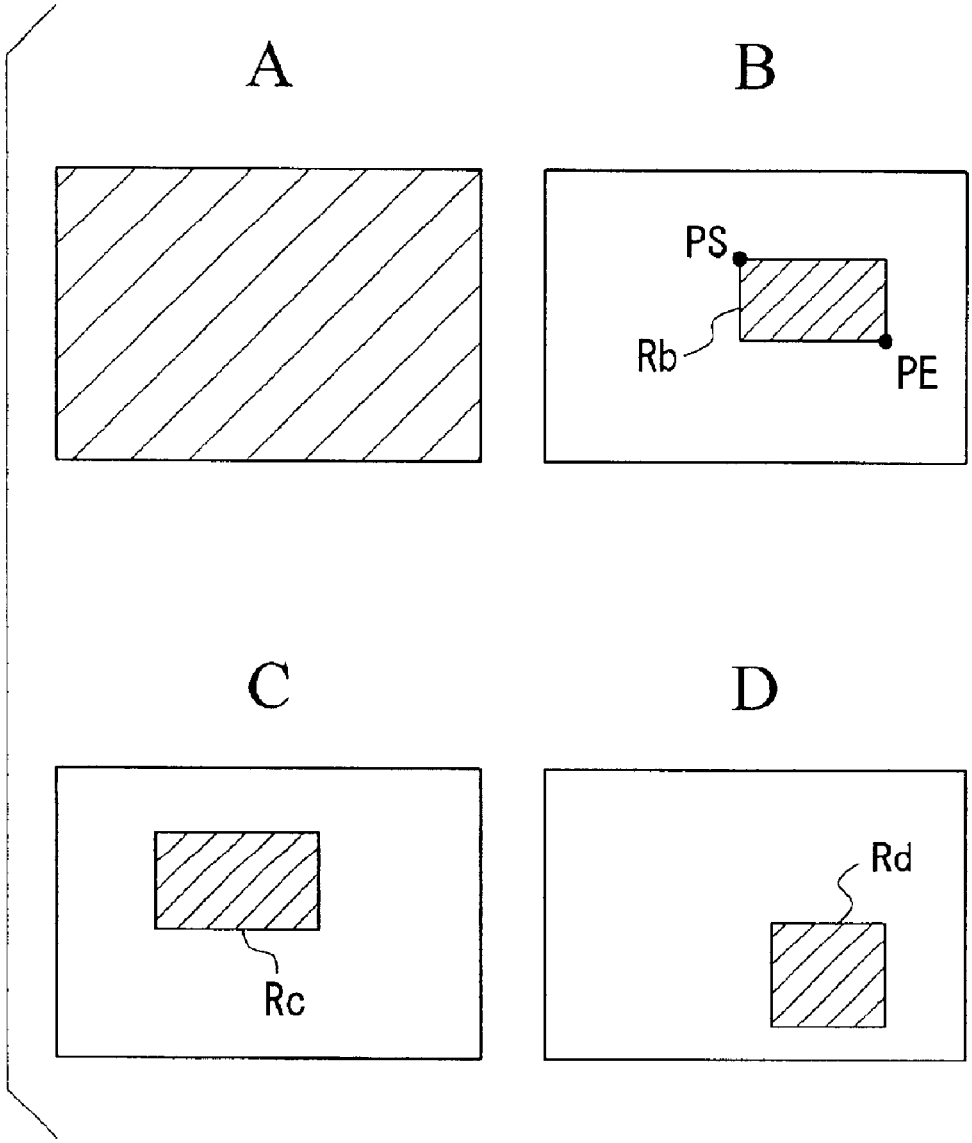
FIG. 2 diagrammatically shows four planes A–D that construct one frame of image being displayed on a screen of a display.
Figure 3:
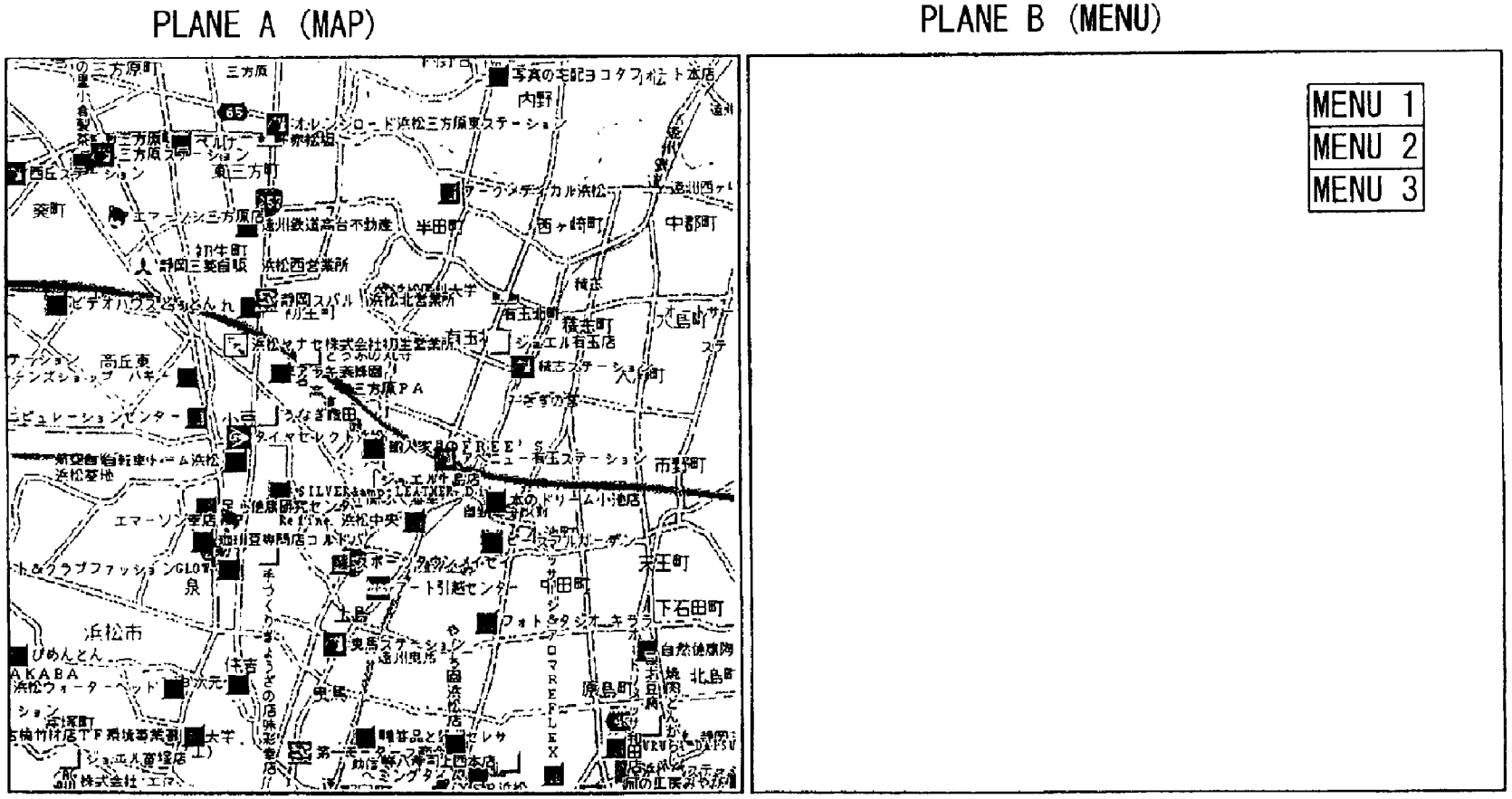
FIG. 3 shows concrete examples of images stored on the planes A and B.
Figure 4:
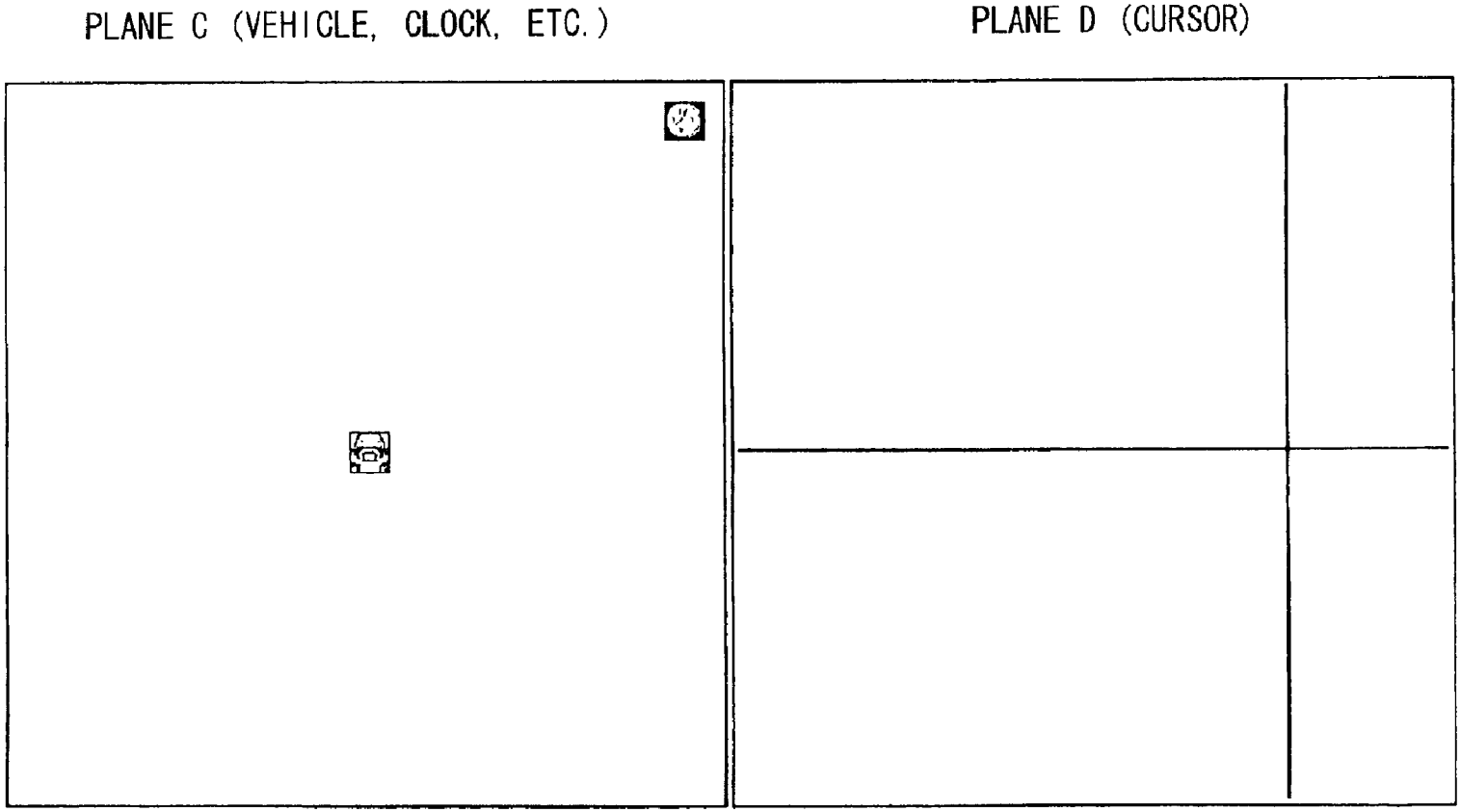
FIG. 4 shows concrete examples of images stored on the planes C and D.
Figure 5:
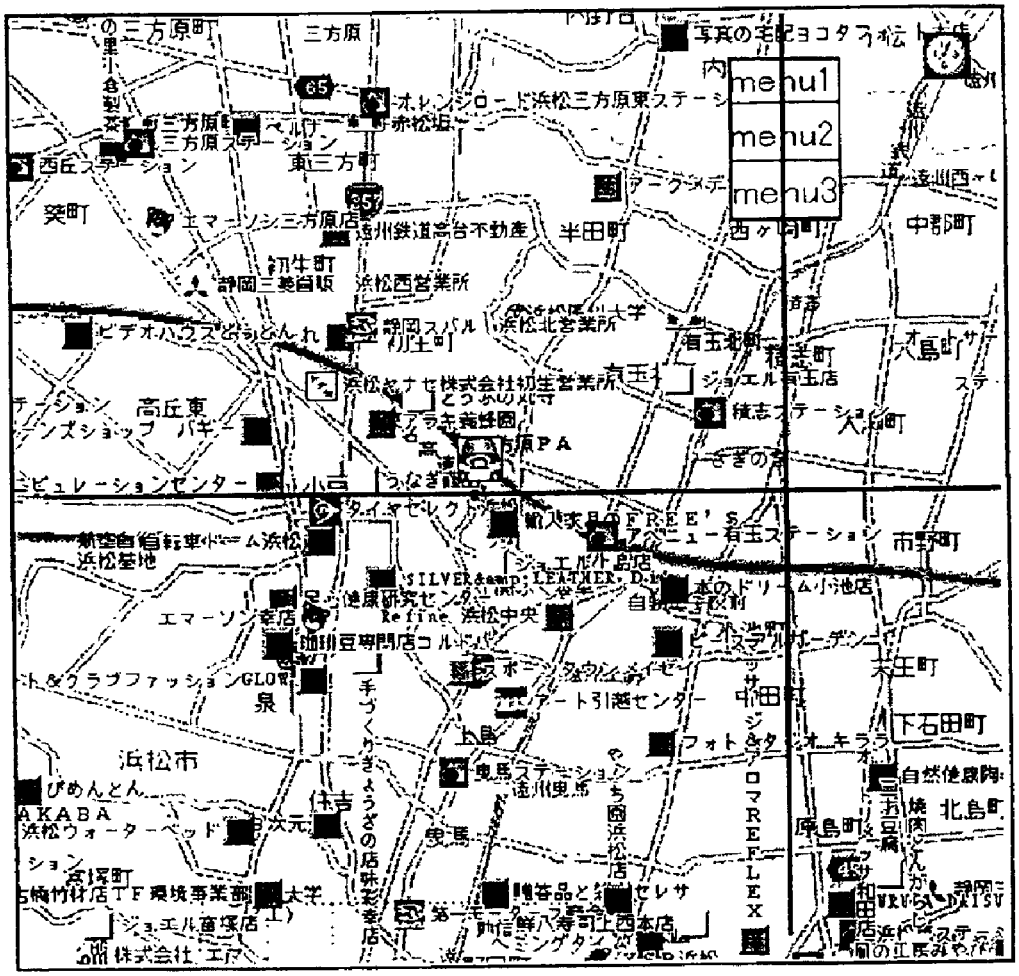
FIG. 5 shows a concrete example of a complete image corresponding to a combination of the images of the planes A–D.

The display control apparatus 7 is configured such that one frame (or one complete image) of picture displayed on the screen of the display 8 is a combination of images stored on four planes. FIG. 2 shows examples of the four planes. Namely, a plane A covers an entire area of the screen, a plane B contributes to display of a region Rb on the screen, a plane C contributes to display of a region Rc on the screen, and a plane D contributes to display of a region Rd on the screen. In the planes B, C and D, surrounding areas of the regions Rb, Rc and Rd are transparent. In addition, the planes A–D are given a specific priority order in display, that is, an order of D, C, B and A. FIG. 3 shows concrete examples of images of the planes A and B, and FIG. 4 shows concrete examples of images of the planes C and D. Namely, the plane A represents an image of a geographic map, the plane B represents an image of menus, the plane C represents images of a car and a clock, and the plane D represents cursors (i.e., horizontal and vertical lines crossing each other). FIG. 5 shows a complete image of one frame that is created by superimposing the aforementioned images of the planes A–D. An example of the image shown in FIG. 5 is actualized by the display control apparatus 7, which is applied to a car navigation system.

Figure 6:
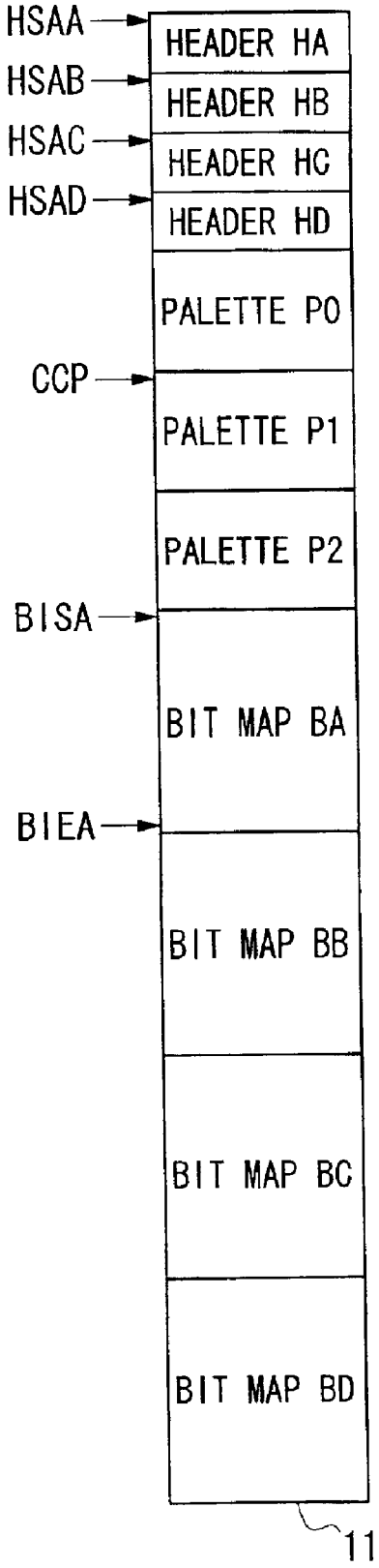
FIG. 6 is a memory map showing arrangement of data stored in a VRAM of the display control apparatus.

FIG. 6 shows contents of the display data that are written to the VRAM 11. Namely, the display data are configured by header data HA–HD of the planes A–D, palette data P0–P2 for use in replacement of color palettes, and bitmap data BA–BD for use in display of regional images of the planes A–D. Herein, both of the header data and bitmap data are provided in connection with the four planes A–D respectively. In contrast, the palette data are not provided in connection with the four planes A–D respectively because each palette data can be shared by two or more planes.

Figure 7:
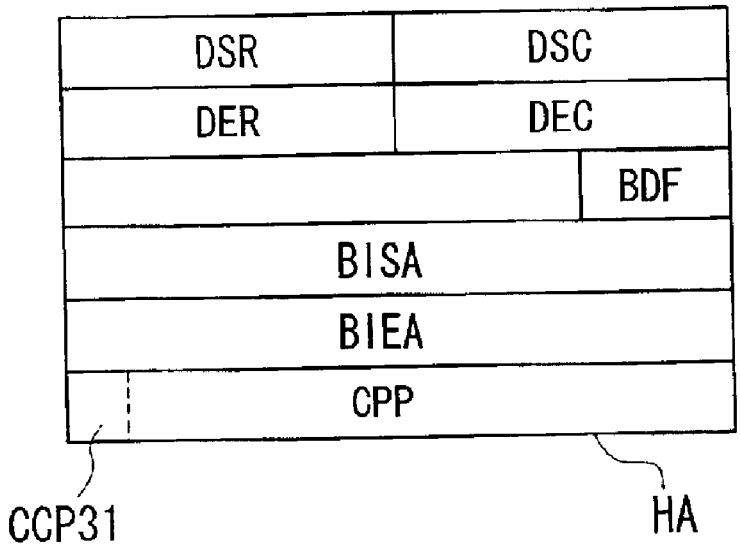
FIG. 7 shows an example of a configuration of header data.

FIG. 7 shows an example of a configuration of the header data, which contain prescribed data elements as follows:

DSR: display start row

DSC: display start column

DER: display end row

DEC: display end column

The aforementioned data elements show positions of the region in each plane. In the case of the region Rb of the plane B shown in FIG. 2, for example, an upper-left point PS is designated by coordinates (DSR, DSC), and a lower-right point PE is designated by coordinates (DER, DEC).

BDF: bitmap data format

This data element shows a format of bitmap data. In general, color display data contain color codes and primary color data such as red data R, green data G and blue data B. For example, BDF=1 is set to the bitmap data BA to which color codes are written, while BDF=0 is set to the bitmap data BA to which RGB color data are written. It is required that the color palette converts color codes to RGB color data. Of course, it is not always required for the color palette to proceed to conversion of the RGB color data.

BISA: bitmap image start address

BIEA: bitmap image end address

That is, the data element BISA designates a start address of the bitmap data, and the data element BIEA designates an end address of the bitmap data. In the case of the plane A having the header data HA, for example, the aforementioned data elements designate a top address and a last address of the bitmap data BA shown in FIG. 6.

CPP: color palette pointer

This data element designates a top address of the color palette used by the plane. In the case of the plane using the color palette PI, for example, a top address of the color palette P1 shown in FIG. 6 is written to the color palette pointer CPP. Incidentally, a MSB 'CPP31' of the color palette pointer CPP is used for a special purpose, which will be described later.

The aforementioned data elements are read from the CD-ROM and are written to the VRAM 11. The CD-ROM also stores other data elements, which are read out therefrom and are written to a register 12*a* of a VRAM controller 12. Those data elements will be described below with reference to FIG. 8.

HSAA: header start address A

HSAB: header start address B

HSAC: header start address C

HSAD: header start address D

The aforementioned data elements HSAA–HSAD respectively designate top addresses of the header data HA–HD shown in FIG. 6. Those data elements have most significant bits (MSB) HSAA31, HSAB31, HSAC31 and HSAD31, each of which indicates existence of an image to be displayed on the screen of the display 8. That is, no display image exists on the plane A if HSAA31=1, while display image exists on the plane A if HSAA31=0.

Next, a description will be given with respect to the VRAM controller 12. The VRAM controller 12 read in display data stored on the CD-ROM, so that a set of header start addresses HSAA to HSAD are written to the register 12*a* while other data elements are sequentially written to the VRAM 11. If HSAA31=0, the VRAM controller 12 reads header data HA from the header start address HSAA of the display data with respect to the plane A. Then, the VRAM controller 12 extracts data elements DSR, DSC, DER, DEC from the header data HA to deliver them to a display data processor 17 via a selector 14.

Next, the VRAM controller 12 checks an output signal COL of a color palette replacer signal generator 15. If the signal COL is set to '1', the VRAM controller 12 proceeds to replacement of content of a color palette (or color palette memory) 13, which is designed to store a prescribed number of words (e.g., 256 words) of data. That is, the VRAM controller 12 reads data of the prescribed number of words, which the VRAM 11 stores in an area starting from an address designated by the color palette pointer CPP. The read data together with their address data are supplied to the color palette 13 to replace its content. If the signal COL is set to '0', the VRAM controller 12 proceeds to next processes without performing replacement of the content of the color palette 13. Details of the color palette replacer signal generator 15 will be described later.

Using bitmap image start/end addresses BISA, BIEA contained in the header data HA, the VRAM controller 12 sequentially reads bitmap data BA from the display data, so that the bitmap data BA are sequentially supplied to the color palette 13 and selector 14. At this time, a bitmap data format BDF contained in the header data HA is forwarded to a select terminal SE of the selector 14. If the bitmap data BA are described by color codes, the bitmap data format BDF is set to '1', so that the bitmap data BA are converted to RBG color data by the color palette 13. The RGB color data are supplied to the display data processor 17 via the selector 14. On the other hand, if the bitmap data BA are described by RGB color data, the bitmap data format BDF is set to '0', so that the bitmap data BA are directly supplied to the display data processor 17 via the selector 14 without conversion.

Illustration of FIG. 1 is simplified to show only a single set of the color palette 13, selector 14 and color palette replacer signal generator 15. Actually, the display control apparatus 7 provides four sets of the aforementioned circuit elements in connection with the four planes A–D respectively.

Figure 8:
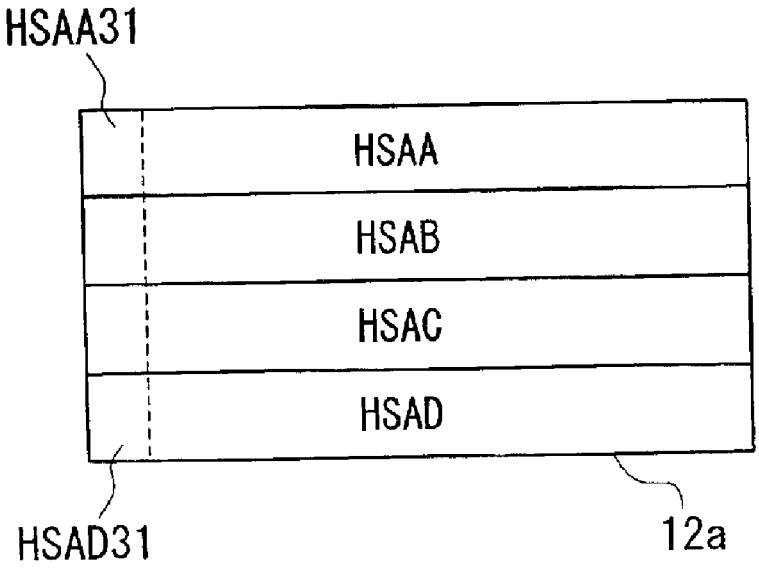
FIG. 8 shows an internal configuration of a register of a VRAM controller of the display control apparatus.

Using the header start address HSAB stored in the register 12*a* shown in FIG. 8, the VRAM controller 12 reads header data HB with respect to the plane B. Then, the aforementioned processes are performed on the header data HB so that using bitmap start/end addresses BISA, BIEA contained in the header data HB, bitmap data BB are sequentially read from the display data. Thus, the bitmap data BB are directly supplied to the display data processor 17, or the color palette 13 converts the bitmap data BB to RGB color data which are supplied to the display data processor 17. Similar processes are performed on header data HC, HD so that bitmap data BC, BD are similarly supplied to the display data processor 17 with respect to the planes C and D respectively.

Figure 9:
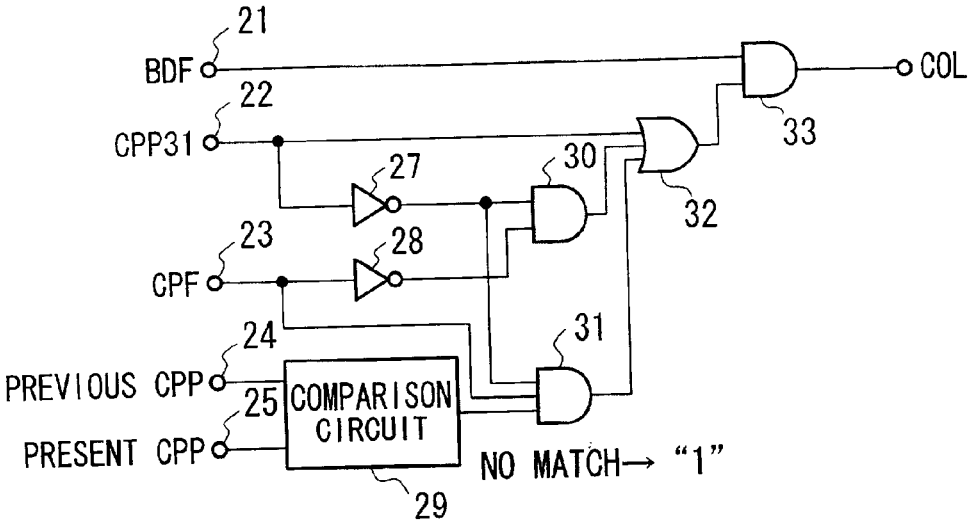
FIG. 9 is a logic circuit diagram of a color palette replacer signal generator of the display control apparatus.

Next, the color palette replacer signal generator 15 will be described with reference to a logic circuit diagram of FIG. 9. The color palette replacer signal generator 15 has five input terminals 21 to 25 receiving various types of signals and data output from the VRAM controller 12. Namely, the bitmap data format BDF is applied to the terminal 21, CPP31 (namely, MSB of the color palette pointer CPP) is applied to the terminal 22, and a transfer complete flag CPF is applied to the terminal 23. Herein, the transfer complete flag CPF is set to '1' when the VRAM controller 12 completes data transfer to the color palette 13. In addition, there are provided two color palette pointers CPP, namely a previous CPP and a present CPP which are respectively applied to the terminals 24 and 25. The previous CPP is contained in the header data for use in a previous cycle of image display, and the present CPP is contained in the header data for use in a present cycle of image display in progress. When the transfer complete flag CPF is set to '1', the previous CPP is written to an internal register of the VRAM 12, from which it is forwarded to the terminal 24. The color palette replacer signal generator 15 shown in FIG. 9 contains two inverters 27, 28 and a comparison circuit 29. The comparison circuit 29 outputs '0' signal only when the present CPP matches with the previous CPP. In addition, the color palette replacer signal generator 15 also contains three AND gates 30, 31, 33 and one OR gate 32.

Figure 10:
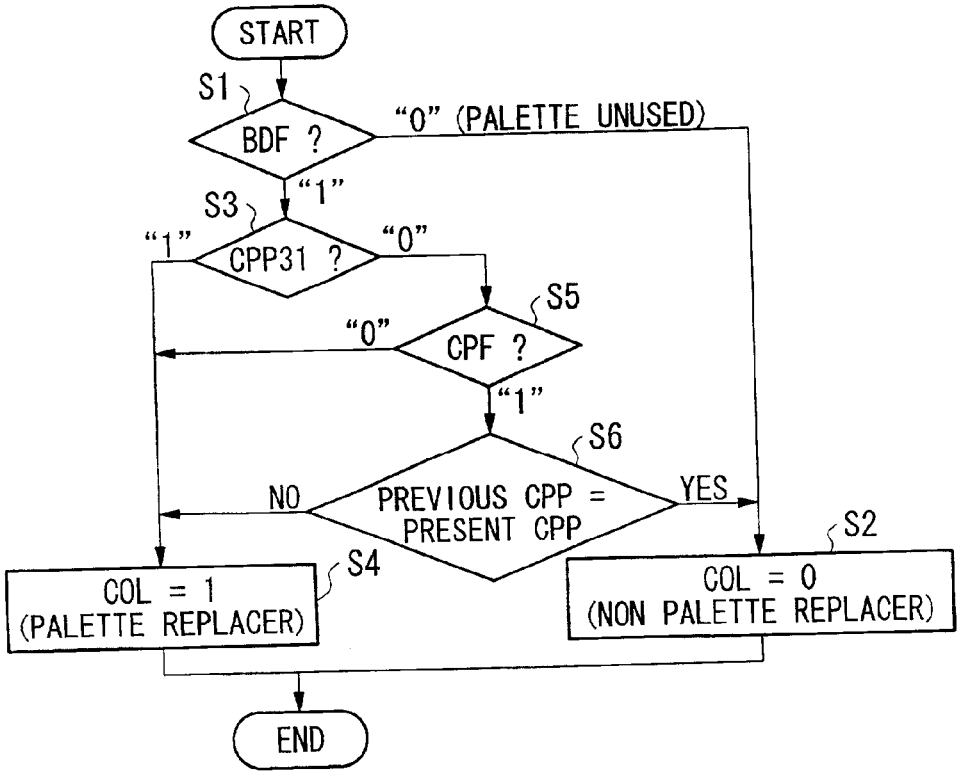
FIG. 10 is a flowchart showing operations of the color palette replacer signal generator.

Next, operations of the color palette replacer signal generator of FIG. 9 will be described with reference to a flowchart of FIG. 10.

If the bitmap data format BDF is set to '0', the bitmap data (BA–BD) are described in the form of the RGB color data. In this case, there is no need to perform conversion by the color palette 13, hence, the AND gate 33 outputs a signal COL having logic '0' indicating a non-transfer mode of data for the color palette 13. Namely, if BDF=0, a flow proceeds from step S1 to step S2 in which the VRAM controller 12 does not proceed to replacement of content of the color palette 13 because of COL=0. If both of BDF and CPP31 are set to '1', all of two inputs of the AND gate 33 are logic '1' because an output of the OR gate 32 is logic '1'. In this case, the AND gate 33 outputs a COL signal having logic '1' indicating a transfer mode of data for the color palette 13. Namely, if BDF=1 and CPP31=1, the flow sequentially proceeds to steps S1, S3 and S4, in which the VRAM controller 12 proceeds to replacement of the content of the color palette 13 because of COL=1.

If CPP31 is set to '0' and the transfer complete flag CPF is set to '0' indicating 'transfer incomplete', outputs of the inverters 27, 28 are logic '1' so that an output of the AND gate 30 is logic '1', which is applied to an input of the AND gate 33 via the OR gate 32. Therefore, an output of the AND gate 33 is logic '1' because of BDF=1, so that the AND gate 33 provides a signal COL having logic '1'. Namely, if CPP31=0 and CPF=0 under the condition where BDF=1, the flow sequentially proceeds to steps S1, S3, S5 and S4, in which the VRAM controller 12 proceeds to replacement of content of the color palette 13 because of COL=1. If CPP31 is set to '0' and CPF is set to '1' indicating 'transfer complete' under the condition where the present CPP does not match with the previous CPP, an output of the inverter 27 is logic '1' while the comparison circuit 29 provides logic '1' because of no match of the present CPP and previous CPP. That is, all of three inputs of the AND gate 31 are logic '1', so that the AND gate 31 provides logic '1', which is forwarded to an input of the AND gate 33 via the OR gate 32. Therefore, an output of the AND gate 33 is logic '1' because of BDF=1, so that the AND gate 33 provides a signal COL having logic '1'. Namely, if CPP31=0 and CPF=1 under the condition where the present CPP does not match with the previous CPP, the flow sequentially proceeds to steps S1, S3, S5, S6 and S4, in which the VRAM controller 12 proceeds to replacement of content of the color palette 13. In the above, if the present CPP matches with the previous CPP, the comparison circuit 29 provides logic '0' so that an output of the AND gate 31 becomes logic '0', which is forwarded to an input of the AND gate 33 via the OR gate 32. Therefore, the AND gate 33 outputs a signal COL having logic '0'. Namely if the CPP31=0 and CPF=1 under the condition where the present CPP matches the previous CPP, the flow sequentially proceeds to steps S1, S3, S5, S6, and S2, in which the controller 12 does not proceed to replacement of content of the color palette 13.

In the case where the bitmap data format BDF is set to '1' indicating use of the color palette 13, the color palette replacer signal generator 15 unconditionally outputs a signal COL having logic '1' designating replacement of content of the color palette 13 if CPP31 (i.e., MSB of the color palette pointer CPP) is set to '1'. If CPP31 is set to '0', the color palette replacer signal generator 15 outputs a signal COL having logic '1' designating replacement of content of the color palette 13 only when the present CPP differs from the previous CPP. That is, the signal COL (namely, color palette replacer instruction) is adequately controlled to avoid unnecessary replacement of the content of the color palette 13. Thus, it is possible to reduce overall time for use in replacement of the content of the color palette 13 in the display control apparatus 7.

The display system of FIG. 1 contains a synchronizing signal generator 18 that generates various types of timing signals such as horizontal synchronizing signals and vertical synchronizing signals for horizontal scanning and vertical scanning of the display 8 in accordance with a system clock (not shown). The aforementioned signals generated by the synchronizing signal generator 18 are delivered to the VRAM controller 12, display data processor 17 and display 8.

The display data processor 17 has bitmap memories in connection with the planes A–D respectively. In horizontal retrace periods of the display 8, RGB color data output from the selector 14 are written to the bitmap memories with respect to the planes respectively. In synchronization with horizontal scanning, the RGB color data of the bitmap memories are read out in parallel and are placed under display priority decisions with respect to each of dots being displayed on the screen of the display 8. Due to the display priority decisions, RGB color data are adequately selected and sequentially output from the display data processor 17. A digital-to-analog converter (DAC) 19 converts the RGB color data, output from the display data processor 17, to analog color signals, which are forwarded to the display 8. Based on the analog color signals, the display 8 displays color images on the screen thereof. If the display 8 is designed as a digital display, it is unnecessary to use the digital-to-analog converter 19. In this case, the 'digital' display 8 displays color images directly based on the RGB color data output from the display data processor 17.

As described above, the display control apparatus of this invention is characterized by that the VRAM controller does not proceed to replacement of content of the color palette if a present top address of the color palette matches with a previous top address of the color palette with respect to each plane. Since the display control apparatus is designed not to waste time for unnecessary color palette replacement with respect to each plane, it is possible to considerably reduce overall time for replacement of the content of the color palette.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A display control apparatus comprising:

a video memory for storing color data, which are used to designate colors for displayed dots, palette data for use in conversion of the color data and address data representing addresses of the color data and the palette data;

a first video memory controller for reading the palette data from the video memory in accordance with the address data, so that read palette data are written to a color palette memory;

a second video memory controller for reading the color data from the video memory in accordance with the address data, so that read color data are subjected to conversion on the color palette memory in accordance with the palette data; and an output circuit for outputting either the color data read from the video memory or converted color data output from the color palette memory to a display, wherein at completion of writing the previous palette data to the color palette memory, the first video memory controller retains the previous address data designating the previous palette data in a register, the first video memory controller determines whether to replace content of the color palette memory by comparison between the present address data and the previous address data such that if present address data designating present palette data matches with previous address data designating previous palette data, the first video memory controller does not write the present palette data to the color palette memory.

2. A display control apparatus comprising:

a video memory for storing color data, which are used to designate colors for displayed dots, a color palette replacer instruction, palette data for use in conversion of the color data and address data representing addresses of the color data and the palette data;

a first video memory controller for reading the palette data from the video memory in accordance with the address data, so that read palette data are written to a color palette memory;

a second video memory controller for reading the color data from the video memory in accordance with the address data, so that read color data are subjected to conversion on the color palette memory in accordance with the palette data; and an output circuit for outputting either the color data read from the video memory or converted color data output from the color palette memory to a display, wherein if present address data designating present palette data match with previous address data designating previous palette data, the first video memory controller does not write the present palette data to the color palette memory, if the color palette replacer instruction designates the color palette replacement, the first video memory controller proceeds to replace the content of the color palette memory unconditionally, regardless of the present or previous address data.

3. A display control apparatus comprising:

a video memory for storing display data that contain header data, palette data and bitmap data in connection with a plurality of planes which are combined together to form one frame, wherein the header data contain a color palette pointer and a color palette replacer instruction with respect to each of the planes;

a color palette memory for storing color palettes with respect to the plurality of planes;

a video memory controller for reading the palette data and the bitmap data from the video memory in accordance with addresses designated by the header data; and a color palette replacer signal generator for generating a color palette replacer signal based on the header data so as to make determination whether to replace content of the color palette with respect to each of the planes, wherein if the color palette replacer instruction designates color palette replacement, the video memory controller unconditionally replaces previous palette data with present palette data on the color palette memory, while if the color palette replacer instruction does not designate color palette replacement, the video memory controller replaces the previous palette data with the present palette data on the color palette memory only when a present color palette pointer designating the present palette data differs from a previous color palette pointer designating the previous palette data.

4. A display control apparatus according to claim 3 wherein the header data contain a bitmap data format representing a format of the bitmap data with respect to each of the planes, so that the bitmap data are converted to RGB color data on the color palette memory in response to the bitmap data format.

5. A display control apparatus comprising:

a video memory for storing color data, which are used to designate colors for displayed dots, a color palette replacer instruction, palette data for use in conversion of the color data and address data representing addresses of the color data and the palette data;

a first video memory controller for reading the palette data from the video memory in accordance with the address data, so that read palette data are written to a color palette memory;

a second video memory controller for reading the color data from the video memory in accordance with the address data, so that read color data are subjected to conversion on the color palette memory in accordance with the palette data; and an output circuit for outputting either the color data read from the video memory or converted color data output from the color palette memory to a display, wherein at completion of writing the previous palette data to the color palette memory, the first video memory controller retains the previous address data designating the previous palette data in a register, the first video memory controller determines whether to replace content of the color palette memory by comparison between the present address data and the previous address data such that if present address data designating present palette data match with previous address data designating previous palette data, the first video memory controller does not write the present palette data to the color palette memory, and if the color palette replacer instruction designates the color palette replacement, the first video memory controller proceeds to replace the content of the color palette memory unconditionally, regardless of the present or previous address data.

6. A display control apparatus comprising:

a video memory for storing color data, which are used to designate colors for displayed dots, a color palette replacer instruction, a bitmap data format indicator, palette data for use in conversion of the color data and address data representing addresses of the color data and the palette data;

a first video memory controller for reading the palette data from the video memory in accordance with the address data, so that read palette data are written to a color palette memory;

a second video memory controller for reading the color data from the video memory in accordance with the address data, so that read color data are subjected to conversion on the color palette memory in accordance with the palette data; and an output circuit for outputting either the color data read from the video memory or converted color data output from the color palette memory to a display, wherein if the color palette replacer instruction designates the color palette replacement and the bitmap data format indicator indicates the color data includes color codes, the first video memory controller proceeds to replace the content of the color palette memory unconditionally, regardless of a present address data or a previous address data.

7. A display control apparatus according to claim 6, wherein if the bitmap data format indicator indicates the color data includes Red Blue Green (RGB) color data, the first video memory controller does not write the present palette data to the color palette memory.

8. A display control apparatus according to claim 6, wherein if the color palette replacer instruction does not designate the color palette replacement and if a transfer complete flag (CPF) indicates the present palette data has been transferred to the color palette memory to form previous palette data, and if present address data designating present palette data match with previous address data designating previous palette data, the first video memory controller does not write the present palette data to the color palette memory, and if present address data designating present palette data does not match with previous address data designating previous palette data, the first video memory controller writes the present palette data to replace the content of the color palette memory.

9. A display control apparatus according to claim 6, wherein if the color palette replacer instruction does not designate the color palette replacement and if a transfer complete flag (CPF) does not indicate the present palette data has been transferred to the color palette memory, the first video memory controller writes the present palette data to replace the content of the color palette memory.

10. A display control apparatus according to claim 6, wherein the color palette replacer instruction, a transfer complete flag, and the bitmap data format indicator are input into a combination of logic gates, and the present address data designating present palette data and the previous address data designating previous palette data are input into a comparison circuit whose output is input to the combination of logic gates to effect a result of the combination of logic gates.

11. A display control apparatus according to claim 6, wherein the combination of logic gates includes AND gates, OR gates, and inverters.

* * * * *